US005950537A

United States Patent [19]

Petersen et al.

[11] Patent Number: 5,950,537

[45] Date of Patent: Sep. 14, 1999

[54] FLOAT-MOUNTED PRINTING-GROUP CYLINDER

[75] Inventors: Godber Petersen, Augsburg; Josef Göttling; Bernhard Feller, both of Friedberg; Hans Fleischmann, Augsburg, all of Germany

[73] Assignee: MAN Roland Druckmaschinen AG, Offenbach am Main, Germany

[21] Appl. No.: 08/878,757

[22] Filed: Jun. 19, 1997

[30] Foreign Application Priority Data

Jun. 19, 1996 [DE] Germany ..... 196 24 393

[51] Int. Cl.[6] ..... B41F 5/00

[52] U.S. Cl. ..... 101/216; 101/219; 101/248

[58] Field of Search ..... 101/216, 219, 101/181, 183, 247, 240, 137, 170; 384/582

[56] References Cited

U.S. PATENT DOCUMENTS

| | | | |
|---|---|---|---|
| 1,584,828 | 5/1926 | Wood | 101/219 |
| 2,962,962 | 12/1960 | Smith . | |
| 3,326,439 | 6/1967 | Sarka | 101/216 |
| 3,572,860 | 3/1971 | Hart | 384/582 |
| 3,605,615 | 9/1971 | Huck . | |
| 3,732,813 | 5/1973 | Singh et al. | 101/216 |
| 3,814,014 | 6/1974 | Dahlgren | 101/137 |
| 4,362,098 | 12/1982 | Stelling, Jr. et al. | 101/219 |
| 4,905,598 | 3/1990 | Thomas | 101/219 |
| 4,991,503 | 2/1991 | Morner | 101/170 |
| 5,301,609 | 4/1994 | Guaraldi et al. | 101/216 |
| 5,357,860 | 10/1994 | Shibata et al. | 101/248 |
| 5,461,978 | 10/1995 | Chou | 101/248 |
| 5,481,973 | 1/1996 | Schmid | 101/216 |
| 5,617,789 | 4/1997 | Achelpohl et al. . | |
| 5,649,484 | 7/1997 | Broghammer et al. | 101/248 |

FOREIGN PATENT DOCUMENTS

| | | |
|---|---|---|
| 741 009 | 11/1996 | European Pat. Off. . |
| 38 25 600 | 2/1990 | Germany . |
| 195 15 459 A1 | 10/1996 | Germany . |
| 2-258260 | 10/1990 | Japan . |

*Primary Examiner*—Eugene Eickholt

*Attorney, Agent, or Firm*—Cohen, Pontani, Lieberman & Pavane

[57] ABSTRACT

Disclosed is an apparatus to insure the most even linear force possible in the contact zone across the breadth of cylinder bodies of apparatus positioned next to each other. The printing group cylinders are positioned and maintained via the disclosed arrangement in such a way that adjacent cylinder bodies have an approximately parallel orientation.

4 Claims, 8 Drawing Sheets

FLOAT-MOUNTED PRINTING-GROUP CYLINDER

BACKGROUND OF THE INVENTION

The invention relates to float-mounted printing-group cylinders of a rotary printing machine that are positionable adjacent to each other.

DE 195 15 459.2 discloses a printing group of a rotary printing machine that has float-mounted printing-group cylinders. In this offset printing group, a counterpressure cylinder, a transfer cylinder and a form cylinder are float-mounted in a side wall. The journals will bend when the cylinders are positioned next to each other unless the bearings and journals of these cylinders are highly stable. Furthermore, the bearing play will be pressed out. The cylinder bodies then no longer extend parallel to each other, as shown schematically in FIG. 2. As a result, the linear force in the contact zone of the cylinder bodies is not constant across their breadth. This can negatively affect the print quality of the printed products being produced.

The object of the invention is to provide an assembly that insures the most even linear force possible across the entire breadth of cylinder bodies of float-mounted printing-group cylinders positioned next to each other.

SUMMARY OF THE INVENTION

According to the invention, the above-stated object is obtained in a generic device by incorporating in a rotary print machine means to position the printing-group cylinders of the apparatus in such a way that the cylinder bodies positioned adjacent to each other assume an approximately parallel orientation with respect to one another. The parallel cylinder bodies of the printing-group cylinders positioned next to each other produce a constant pressure, i.e., a constant linear force, in the printing zone across the entire breadth of the cylinder bodies. This is a prerequisite for good print quality.

Other objects and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

DETAILED DESCRIPTION OF THE PRESENTLY PREFERRED EMBODIMENTS

Figure 1:
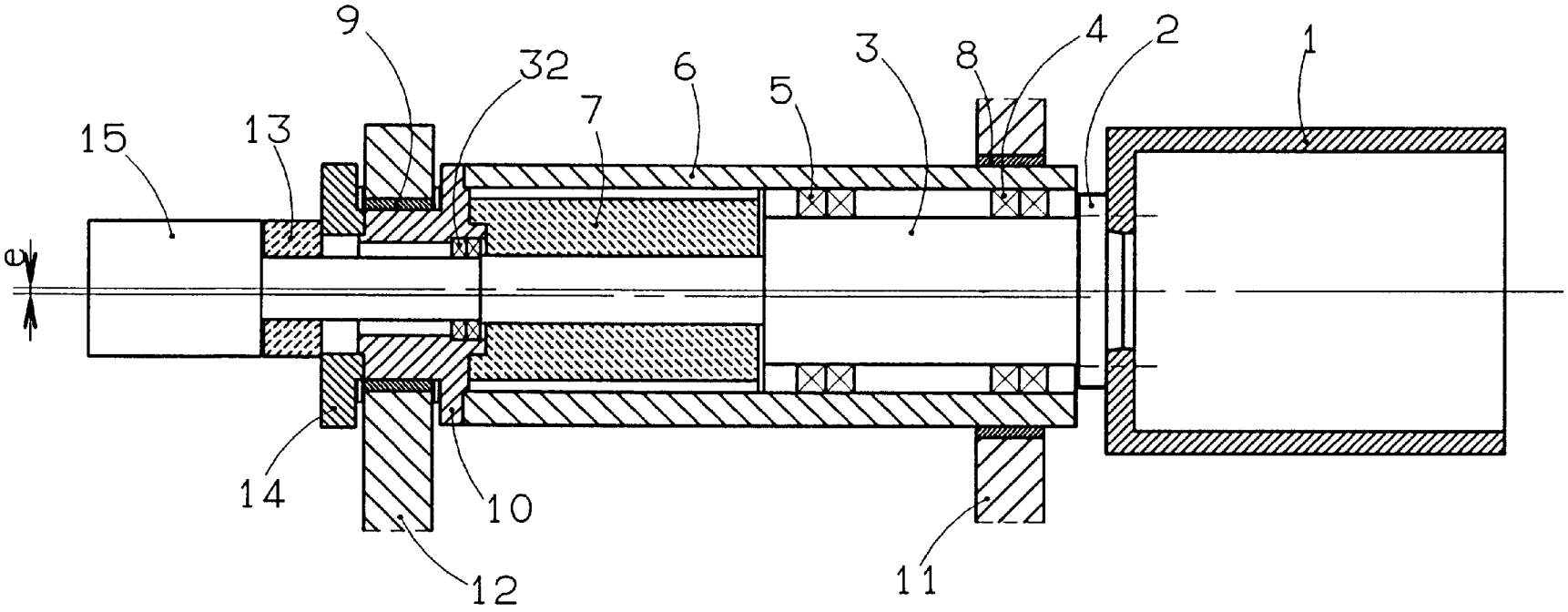
FIG. 1 illustrates a printing-group cylinder (cylinder body and spindle unit), in longitudinal section.

FIG. 1 shows the structure of a printing-group cylinder that has a cylinder body 1 and a journal in the form of a spindle unit, which is shown in section and described below. The cylinder 1 can be, for example, a form cylinder or transfer cylinder of a printing group. The cylinder 1 is pot-shaped and is attached at its bottom to the spindle head 2 of the spindle 3. Advantageously, the attachment of the cylinder body to the spindle head is by screws, and the cylinder 1 is held, without play, by means of a ball socket. The spindle 3 is mounted with high axial and radial rigidity by means of roller bearings 4, 5 in a carrier tube 6. A motor 7, preferably a so-called "kit" motor, is also supported in the carrier tube 6 and is located on an extended journal of the spindle 3, which is also supported by the bearing 32. This arrangement insures a rigid, play-free connection of the motor 7 to the cylinder 1. The carrier tube 6 is mounted in slide bearings 8, 9 in the side wall 11 and in a supporting wall 12. In the example, the carrier tube 6 is sealed by a sleeve 10, which is held by the bearing 9. The second bearing, which is located in the supporting wall 12, provides the carrier tube 6 with especially stable support. The second bearing can be designed, for example, as a plate screwed onto the side wall 11 with spacing supports or as a bridge screwed onto the side wall 11. The carrier tube 6 can be rotated in the slide bearings 8, 9, thus allowing the positioning movements of the cylinder 1, as described below, to be performed. To this end, the spindle 3, along with the cylinder 1, is eccentric to the rotational axis of the carrier tube 6. In the example, the boring in the carrier tube 6 in which the spindle 3 is mounted is eccentric to the outer tube diameter, which carries the bearing seat for accommodation in the slide bearing 8. Similarly, the seat for the bearing 32 in the sleeve 10 is eccentric to the bearing seat for the slide bearing 9.

A rotary encoder 13, required for the purpose of drive control, is attached to the spindle 3 and is supported by the lever 14, which in turn is attached to the sleeve 10. The spindle 3 is sealed by a two-way feed 15, through which a liquid medium for printing process controls, e.g., a coolant, can be fed into and out of the cylinder 1.

Figure 2:
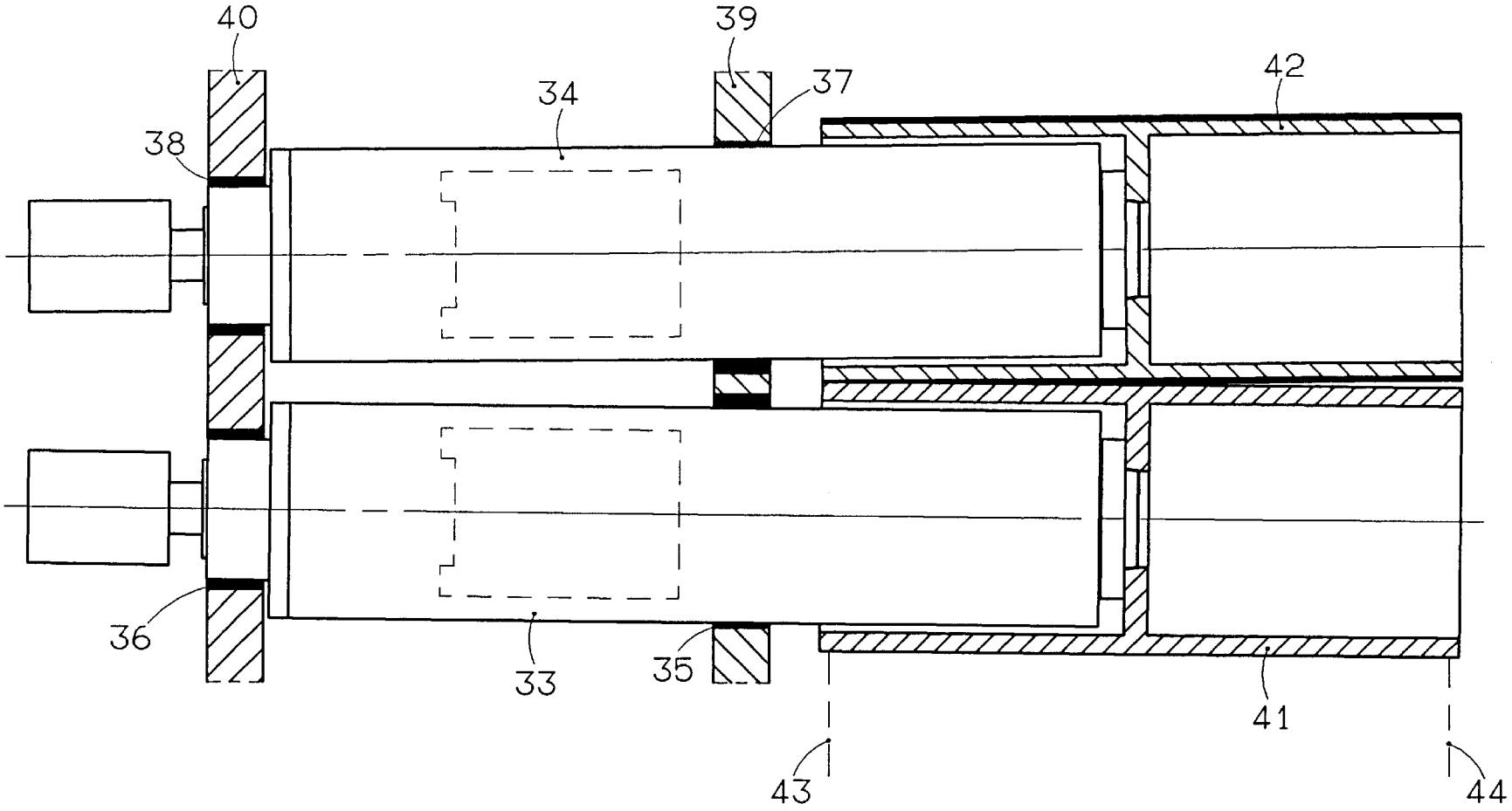
FIG. 2 is a schematic depiction of the bending of two printing-group cylinders positioned next to each other.

FIG. 2 shows how two printing-group cylinders positioned next to each other will bend in the absence of preventative measures. The cylinder bodies are a form cylinder 41 and a transfer cylinder 42, which are attached respectively to spindle units 33 and 34. The spindle units 33 and 34 have substantially the same structure as that shown in FIG. 1 and thus incorporate the journals of the printing-group cylinders. Spindle units of this type are also used as the journals of printing-group cylinders in the following examples. Of course, the invention could also be used for printing-group cylinders that have simple journals mounted directly or by means of eccentric bushings in the side wall, and these cylinder journals could be produced along with the cylinder body from a single piece. In FIG. 2, the form cylinder 41 and the transfer cylinder 42 are attached to the spindle units 33 and 34 in a different manner than that illustrated in FIG. 1, but this is of no consequence with respect to the following description.

The spindle units 33 and 34 are mounted on two planes, embodied by the walls 39 and 40. The second wall 40 can be designed as a bridge screwed onto the wall 39, for example, or as part of a shared box wall or in the form of another frame part. The spindle units 33 and 34 are mounted in the walls 39 and 40 respectively by means of slide bearings 35 to 38. When the form cylinder 41 and the transfer cylinder 42 are positioned next to each other, the spindles of the spindle units 33 and 34 bend under the pressure load, which is expressed as the linear force in the contact zone of the cylinders 41 and 42. This force also presses the bearing play out of the slide bearings 35 to 38. As a result, the form cylinder 41 and the transfer cylinder 42 become skewed relative to one another and assume the positions shown in exaggerated fashion in FIG. 2. The result, as stated above, is that a constant linear force is not produced in the contact zone of the form cylinder 41 and the transfer cylinder 42 across their entire breadth. However, the most constant linear force possible is needed to obtain a good print quality. Deviations disrupt the printing process; here, the transfer of the printing image onto the transfer cylinder 42. Similarly, a constant linear force is necessary between adjacent transfer cylinders positioned here between the transfer cylinder 42 and another cylinder (not shown), which transfer the printing image onto both sides of a web passed between them. The web edges 43 and 44 are indicated schematically in FIG. 2 by the dashed lines. The form cylinder and the transfer cylinder 41 and 42, should be as parallel to each other as possible when under a pressure load, for example, like the cylinders shown in FIG. 10 to maintain a constant printing pressure or linear force across the entire breadth of these cylinders.

The example described below indicates means for purposefully positioning the journals, i.e., the spindle units 33 and 34, one atop the other, on the cylinder side, in such a way that the form cylinder 41 and the transfer cylinder 42, when not positioned next to each other (i.e., when there is no pressure in their contact zone) assume roughly the position shown in FIG. 3. To allow such a skewed position, the slide bearings 35 to 38 are controlled hydrostatic bearings. A controlled hydrostatic bearing is shown in cross-section in FIG. 4.

Figure 5:
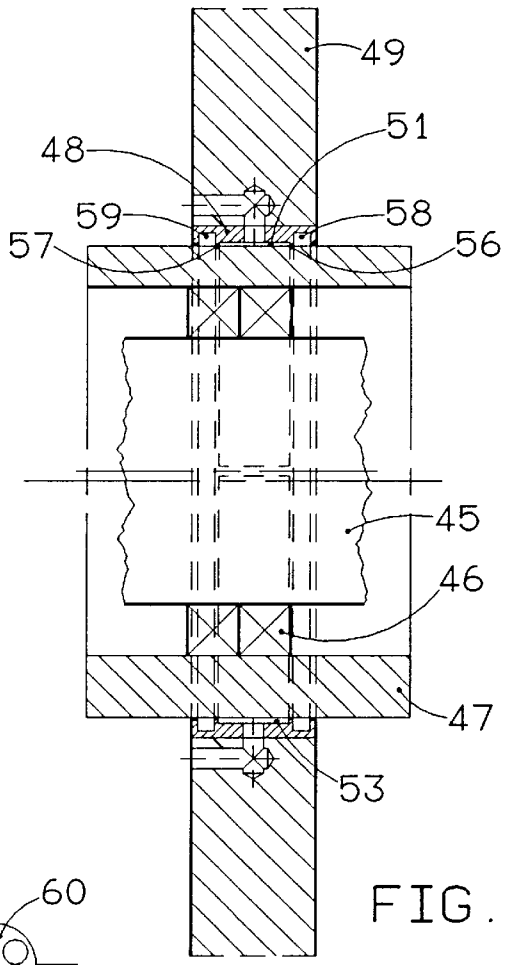
FIG. 5 is a view along view line V—V as in FIG. 4.

Analogous to FIG. 1, the spindle 45 in FIG. 5 is supported by roller bearings 46 in the carrier tube 47, which in turn is mounted by means of the hydrostatic bearing 48 in the wall 49. The bearing 48 consists, for example, of three pockets 50 to 52 distributed around the circumference and separated from each other by spacing pieces 53 to 55. The pockets 50 to 52 on the circumference are sealed in the direction of discharge channels 58 and 59 by the walls 56 and 57. A gearwheel pump 60 forces oil into the pockets 50 to 52 through non-return valves 61 to 63. Measurement value recorders 64 and 65 determine the position of the surface 66 of the printing-group cylinder. The measurement value recorders 64 and 65 are arranged for contact on the circumference of the surface 66 of the cylinder body at a 90° angle relative to each other. Two pairs of measurement value recorders 64 and 65 are provided on two planes of the cylinder body in its edge regions. The measurement value recorders 64 and 65 are operatively connected to a control device 67, which in turn is operatively connected, on the output side, to adjustment devices of choke valves 68 to 70. The choke valves 68 to 70 choke the discharge lines of the pockets 50 to 52. Based on signals from the measurement value recorders 64 and 65, the control device 67 detects deviations of the cylinder body from a predetermined position and sends suitable position-correction signals to the adjustment devices of the choke valves 68 to 70. In this way, the quantity of oil discharged from the pockets 50 to 52, and thus the pressure in these pockets 50 to 52, are controlled according to load.

Figure 3:
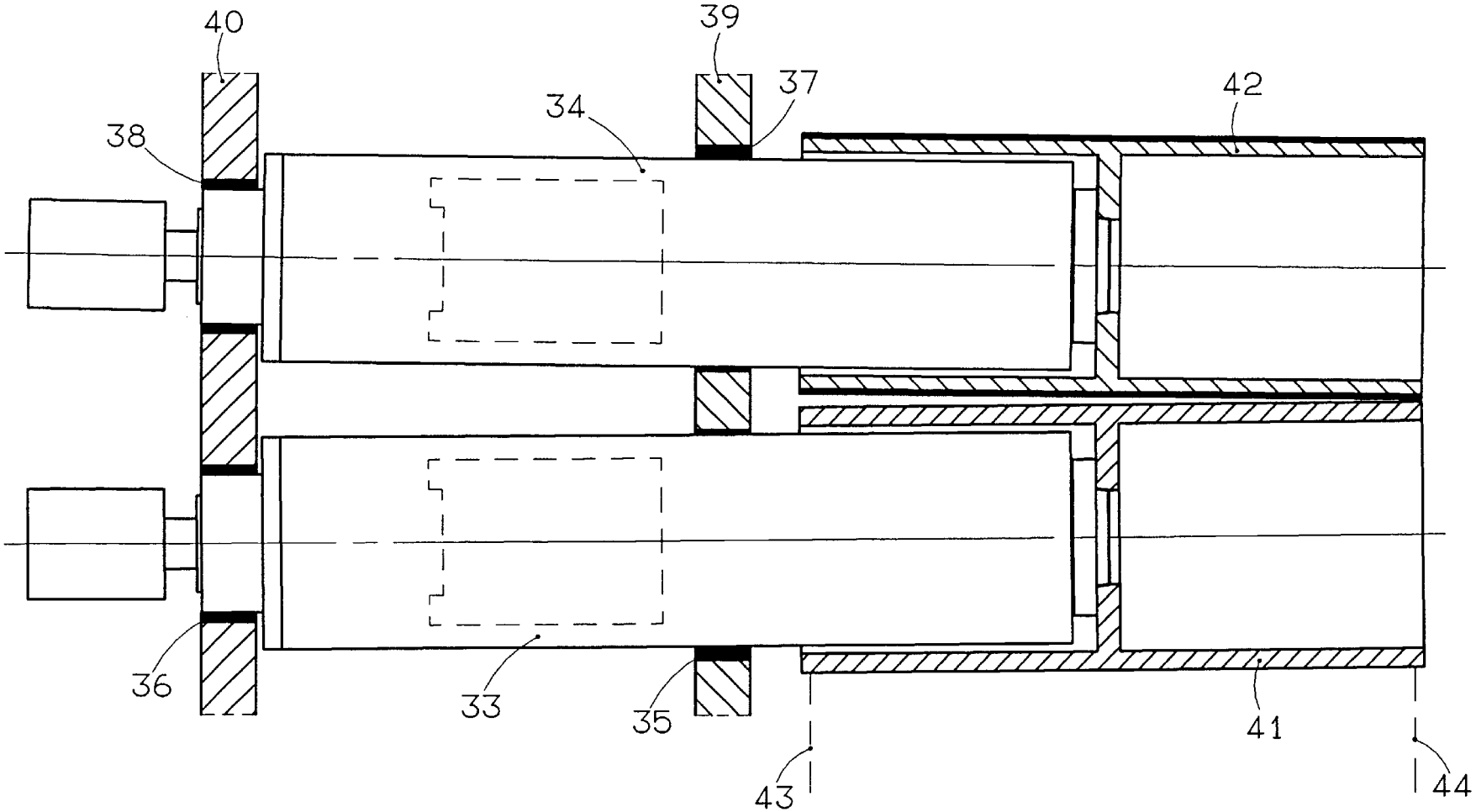
FIG. 3 shows the correction of the journal positions of two printing-group cylinders by means of hydrostatic bearings.

In FIG. 3, the slide bearings 35 to 39 are designed in such a way that the spindle units 33 and 34 can be adjusted according to load. They maintain, independent of the load, their preset position. It is also possible to maintain position setting even when the bearings of only one plane, for example, the slide bearings 35 and 37 in the wall 39, are designed as hydrodynamic bearings.

Figure 4:
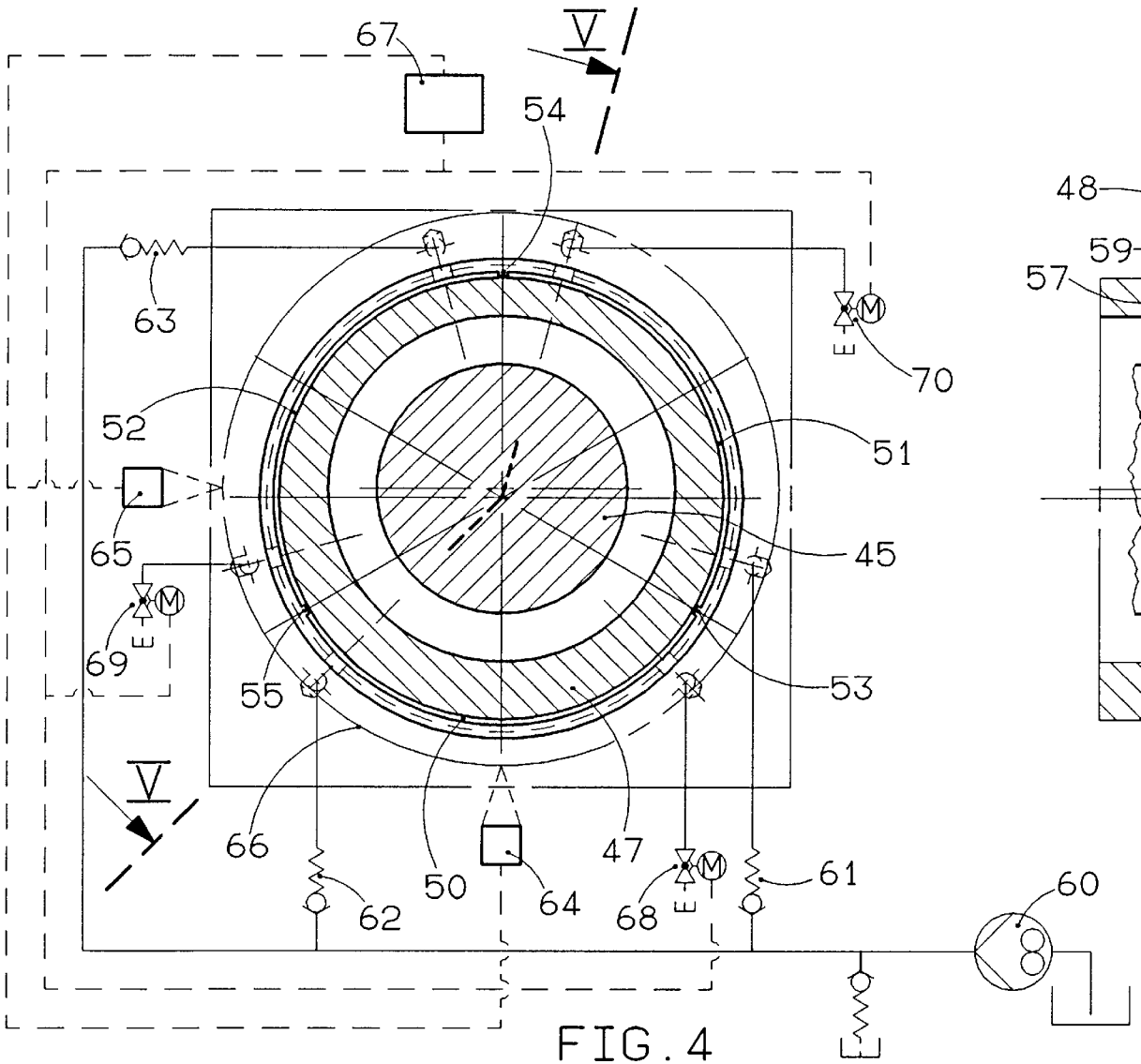
FIG. 4 illustrates, in cross-section, a journal with a hydrostatic bearing.
Figure 7:
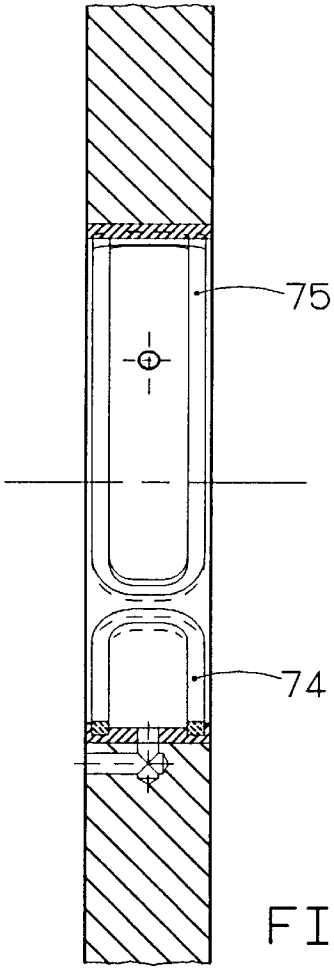
FIG. 7 is a view along view line VII—VII of FIG. 6.
Figure 6:
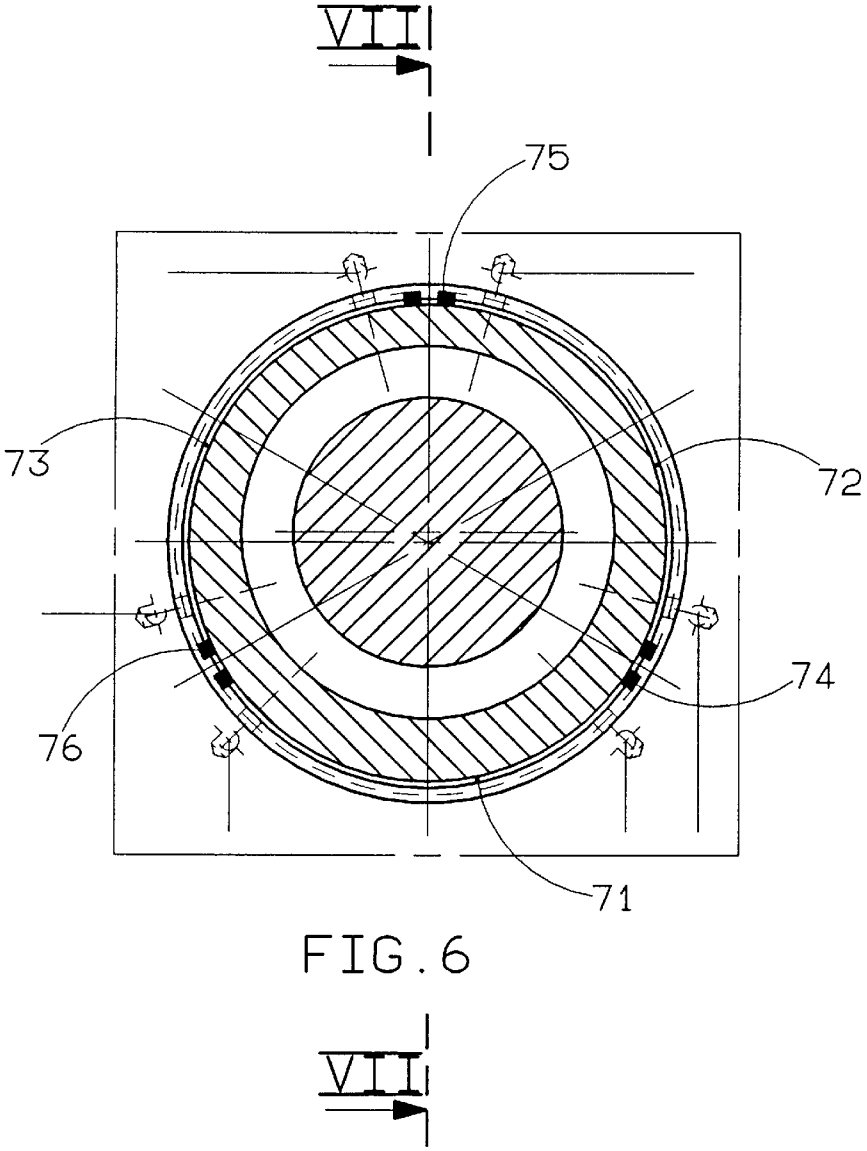
FIG. 6 is a further embodiment of FIG. 4.

FIGS. 6 and 7 show a hydrostatic bearing, in which only the seal of the pockets differs from the bearing 48 in FIGS. 4 and 5. In this case, the pockets 71 to 73 are sealed not by spacing pieces, but rather by seals 74 to 76 with a square cross-section. In all other respects, the structure and the control of the bearing are analogous to that described in connection with FIGS. 4 and 5.

Figure 8:
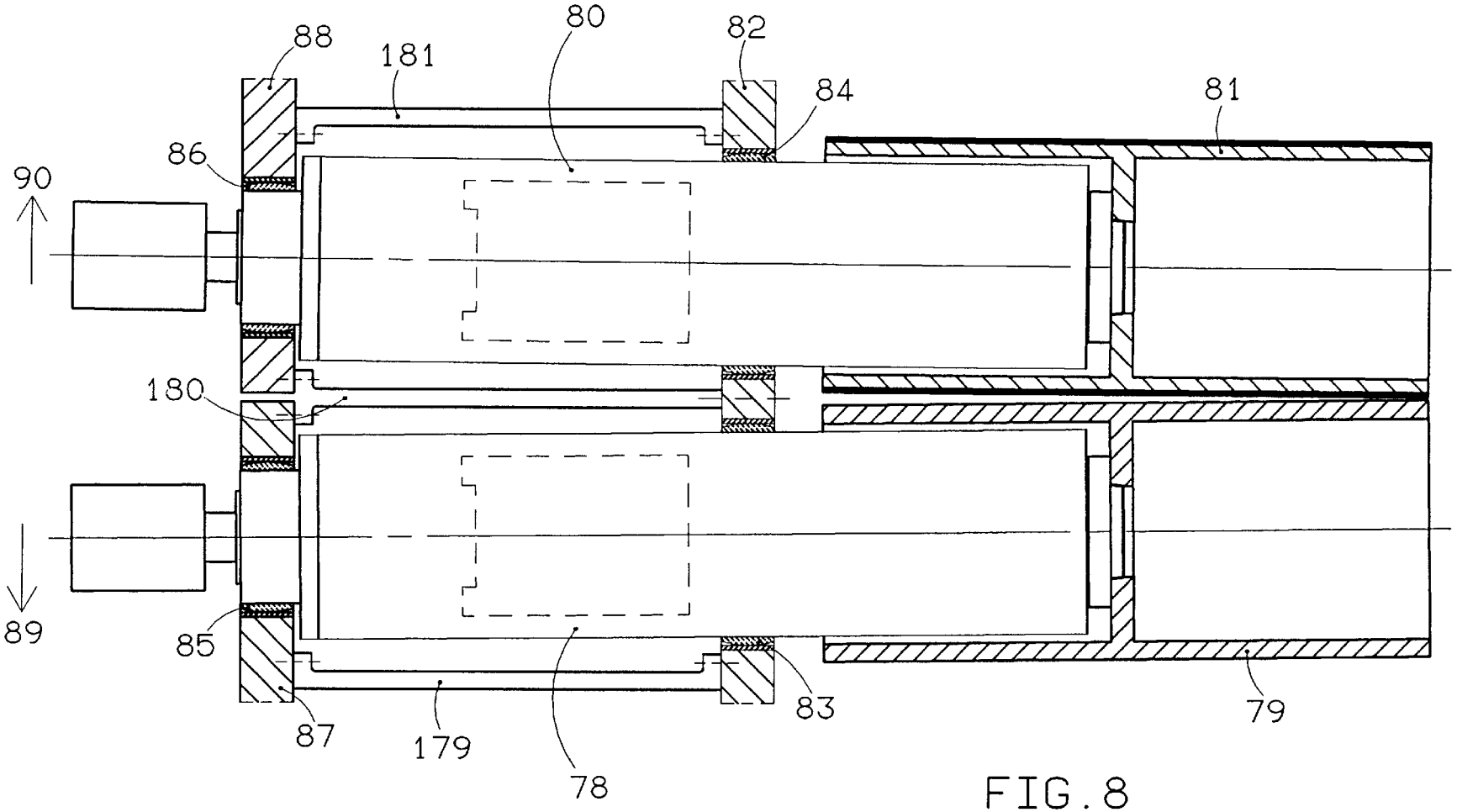
FIG. 8 is an alternate embodiment of that of FIG. 3 in which the crowned slide bearings are offset.
Figure 10:
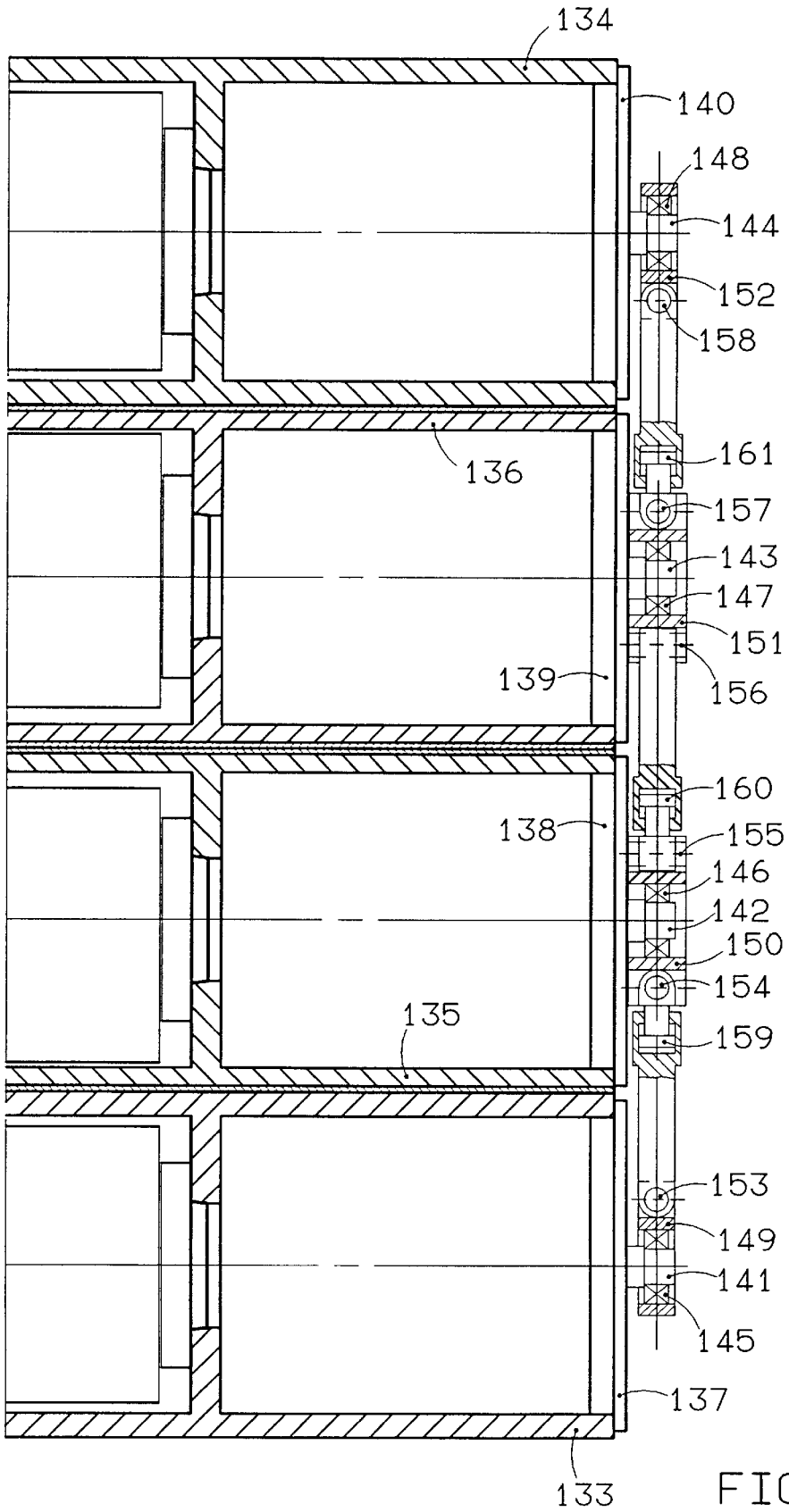
FIG. 10 is a view along view line X—X of FIG. 9.

FIG. 8 shows two printing-group cylinders mounted in crowned slide bearings. A spindle unit 78 carries a form cylinder 79, and a spindle unit 80 carries a transfer cylinder 81. The two spindle units 78 and 80 are mounted in the wall 82 with crowned slide bearings 83 and 84. An additional bearing is located on a plane separated from the wall 82; specifically, the crowned slide bearings 85 and 86 are held by the plates 87 and 88. The plates 87 and 88 are adjustable in the directions 89 and 90, thus permitting the radial offset of the slide bearings 85 and 86. By the one time adjustment of the plates 87 and 88, it is possible to position the axes of the spindle units 78 and 80 as shown in FIG. 8. As a result, the bending of the spindle units and the bearing play in the slide bearings 83 to 86 are compensated for during printing in such a way that the form cylinder 79 and the transfer cylinder 81 lie parallel to each other, as illustrated in FIG. 10. The adjusted plates 87 and 88 are finally secured to supports 179 to 181 which are attached to the wall 82.

It is also possible, however, to control the movement of the plates 87 and 88 based on the deviation of the form cylinder 79 and transfer cylinder 80 from a target position, using a control loop similar to that described in connection with FIG. 4. In this embodiment, the control device 67 activates adjustment units to move the plates 87 and 88. Instead of the slide bearings 85 and 86, the slide bearings 83 and 84 can be embodied in an adjustable fashion and located in suitably movable plates.

Figure 9:
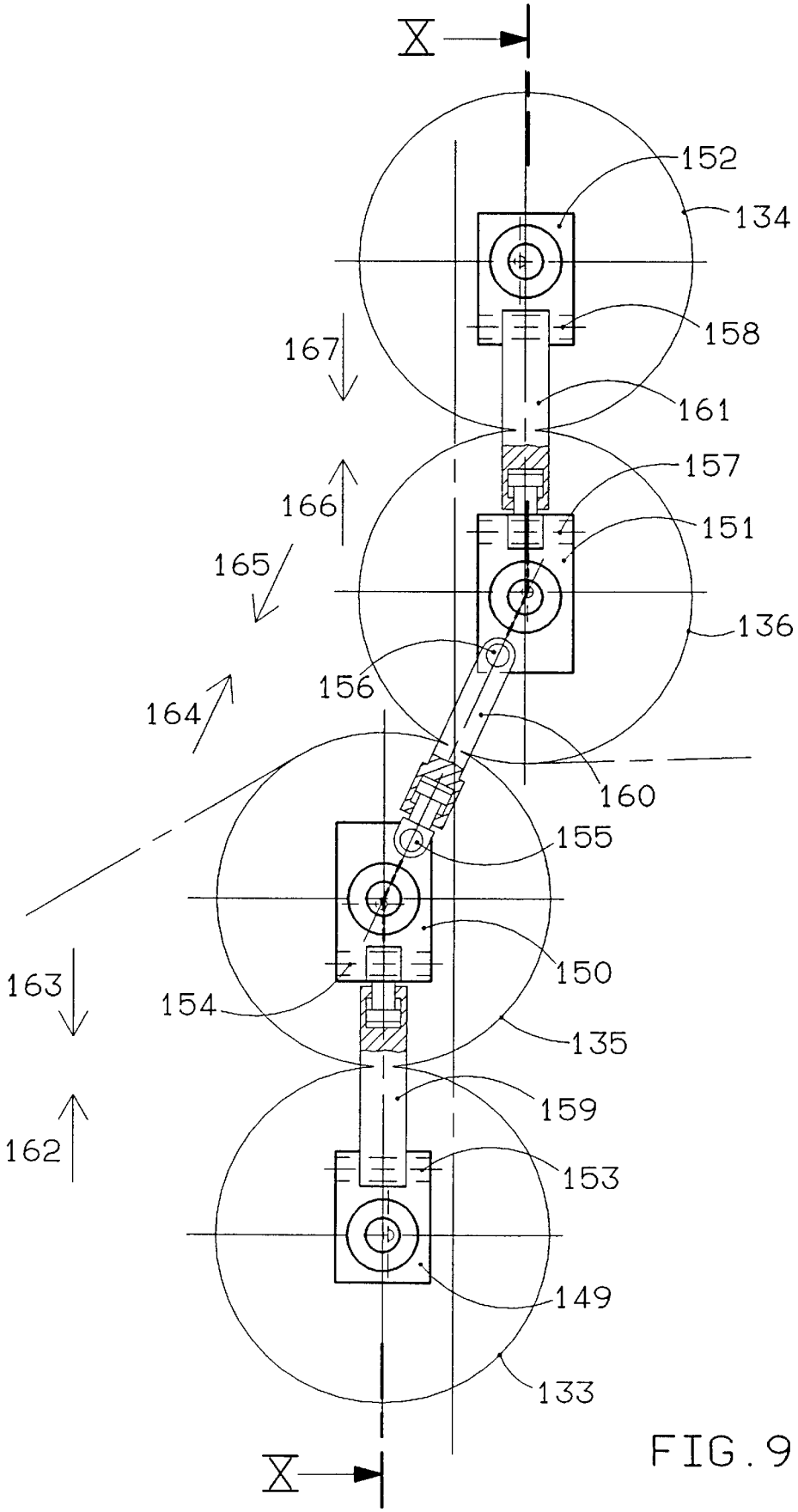
FIG. 9 shows adjustment units for bearing correction at the floating ends of the printing-group cylinders.

FIGS. 9 and 10 show a device that acts on the floating ends of the cylinder bodies of the printing-group cylinders. The form cylinders 133 and 134 and the transfer cylinders 135 and 136 carry, at their ends, disks 137 to 140 with bolts 141 to 144, on which housings 149 to 152 are rotatably mounted in bearings 145 to 148. Adjustment units, e.g., hydraulic cylinders 159 to 161, act on the housings 149 to 152 in articulated fashion via bearing bolts 153 to 158. During printing, the adjustment units clamp the form cylinders 133 and 134 and transfer cylinders 135 and 136 together at defined forces by providing tensile forces in the directions 162 to 167. The form and transfer cylinders 133 to 136 positioned next to each other then assume the parallel orientation shown in FIG. 10. Instead of the hydraulic cylinders 159 to 161, pneumatic cylinders or electrical or electromechanical cylinders can be used. It is also possible to control the tensile forces of the adjustment units 159 to 161.

As shown in to FIG. 4, measurement value recorders 64 and 65 which detect for the positions of the form and transfer cylinders 133 to 136 are connected to a control device which, in this case, controls the tensile forces of the adjustment units 159 to 161 on the output side. If hydraulic cylinders 159 to 161 are engaged, the pressure of the hydraulic oil that feeds them is controlled in this manner.

The invention is not limited by the embodiments described above which are presented as examples only but can be modified in various ways within the scope of protection defined by the appended patent claims.

We claim:

1. An apparatus comprising:

a) float-mounted printing-group cylinders of a rotary printing machine that are positionable adjacent to each other;

b) means to position the printing-group cylinders in such a way that the adjacent cylinder bodies assume a substantially parallel position; and c) a measurement value recorder to detect the cylinder position.

2. The apparatus of claim 1 wherein the measurement value recorders are arranged on the printing-group cylinders.

3. The apparatus of claim 2 wherein the measurement value recorders are operatively connected to a control device that controls the means that position the printing-group cylinders.

4. An apparatus comprising:

a) float-mounted printing-group cylinders of a rotary printing machine that are positionable adjacent to each other, said printing-group cylinders having journals mounted on two planes by bearings, the bearings of at least one plane being radially moveable crown slide bearings and the bearings of the other plane being held in adjustable plates; and b) means to position the printing-group cylinders wherein the adjacent cylinder bodies assume a substantially parallel position, wherein said means acts on the journals with rotational axes and position their rotational axes, on the cylinder side, one upon the other.

* * * * *